US005398970A

United States Patent [19]

Tucky

[11] Patent Number: 5,398,970

[45] Date of Patent: Mar. 21, 1995

[54] SHOES FOR WALKING AND ROLLER SKATING

[76] Inventor: Edward W. Tucky, 2877 N. Bay Dr., Westlake, Ohio 44145

[21] Appl. No.: 98,513

[22] Filed: Jul. 28, 1993

[51] Int. Cl.[6] ..... A63C 17/20

[52] U.S. Cl. ..... 280/841; 280/11.19; 280/11.27; 36/115

[58] Field of Search ..... 280/841, 11.19, 11.27, 280/11.28, 43, 43/24; 36/115

[56] References Cited

U.S. PATENT DOCUMENTS

| | | | |
|---|---|---|---|
| 1,608,368 | 11/1926 | Bugg | 280/11.27 |
| 2,114,790 | 4/1938 | Venables | 280/841 |
| 3,112,119 | 11/1963 | Sweet | 280/841 |
| 3,306,623 | 2/1967 | Weitzner | 280/11.19 |
| 3,884,485 | 5/1975 | Wälle | 280/841 |
| 3,979,842 | 9/1976 | Texidor | 280/11.19 |
| 3,983,643 | 10/1976 | Schreger et al. | 280/11.19 |
| 4,150,499 | 4/1979 | Wang | 280/841 |
| 4,333,249 | 6/1982 | Schaefer | 280/11.19 |
| 4,928,982 | 5/1990 | Logan | 280/11.22 |

*Primary Examiner*—Richard M. Camby
*Attorney, Agent, or Firm*—J. Helen Slough

[57] ABSTRACT

A shoe with skate wheels which can be alternatively used as a walking shoe or a skating shoe. The shoe is constructed so that the skate wheels are quickly, easily, and securely locked into either a retracted walking position or an extended roller skating position.

11 Claims, 2 Drawing Sheets

SHOES FOR WALKING AND ROLLER SKATING

FIELD OF THE INVENTION

This invention relates to a pair of shoes adapted for use as walking shoes and/or roller skating shoes. In particular, there is provided a pair of athletic shoes with extendable and retractable wheels which enable the shoes to be used for either walking or skating.

BACKGROUND OF THE INVENTION

Prior sports devices suitable for walking or roller skating have been provided as shown in U.S. Pat. No. 3,983,643 wherein skating means are extendably and retractably contained within a cavity extending transversely over the entire sole of a shoe, and a longitudinal section connecting the cross-sections. In U.S. Pat. No. 3,979,842 wherein skating means are retractable into a cavity formed by a lower portion of an exerciser secured to the removable sole of a shoe, and within a housing formed as a bottom portion of the sole as shown in U.S. Pat. No. 4,333,249, or a shoe provided with conical disks affixed to a plate secured to the sole as shown in U.S. Pat. No. 4,928,982.

OBJECTS AND SUMMARY OF THE INVENTION

It is an object of the present invention to provide a shoe with skate wheels which shoe is constructed to be alternatively used as a walking shoe or as a roller skating shoe so as to obviate the problems and limitations of the prior art devices.

It is further object of the present invention to provide a shoe with skate wheels which is constructed so that the skate wheels are alternatively and securely locked into either a retracted walking position or an extended skating position.

It is still a further object of the present invention to provide a shoe with skate wheels which is constructed to be easily and quickly converted from a walking shoe to a skating shoe.

It is still a further object of the present invention to provide a shoe with skate wheels which has a flexible construction to enable the wearer to comfortably walk when used as a walking shoe.

In accordance with the invention, there is provided a shoe adapted for walking or skating. The shoe has a sole, with spaced, elongated bores provided therein which extend transversely disposed in the forward and rearward portions of the sole. Axles having wheels mounted on either end thereof adapted to operate as skates are mounted within the elongated bores in the sole of the shoe. Means are provided for locking axles in retracted position within the said elongated bores to secure above the lower surface of the sole of the shoe, so that the shoe is adapted for normal walking and optionally the wheels may be lowered beneath the lower surface of the sole and locked in said position to adapt the shoe for roller skating.

BRIEF DESCRIPTION OF THE DRAWINGS

The structure, operation, and advantages of the presently preferred embodiment of the invention will become further apparent upon consideration of the following description taken in conjunction with the accompanying drawings, wherein.

DETAILED DESCRIPTION OF THE INVENTION

Figure 1:
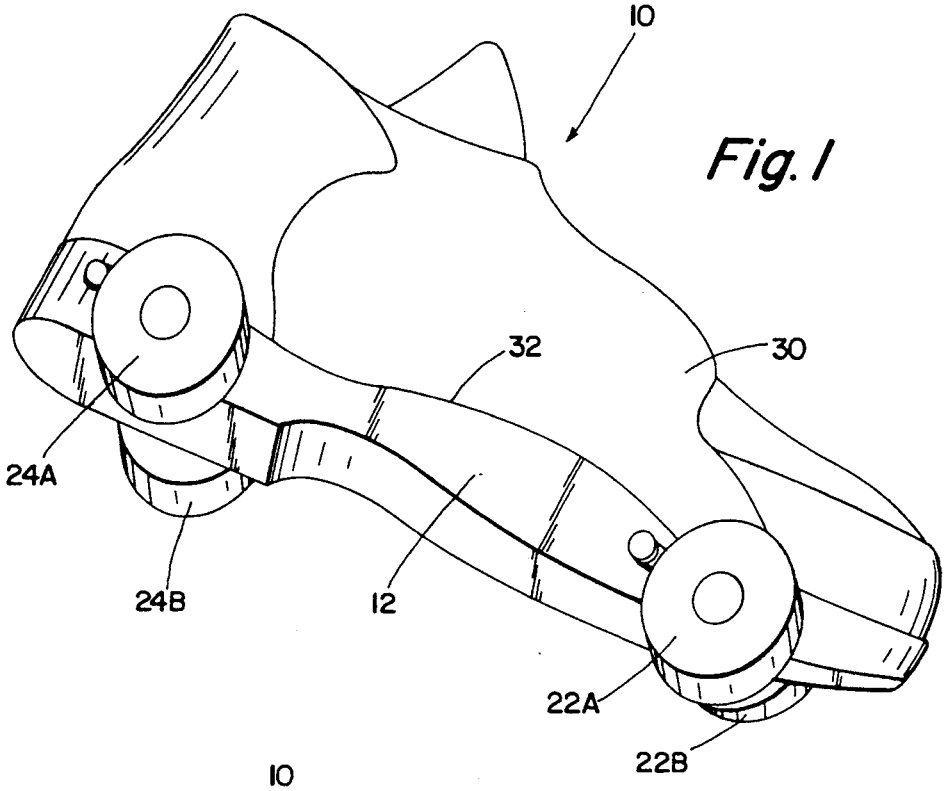
FIG. 1 is a perspective view of the athletic shoe of the present invention showing the same tilted to disclose the bottom of the sole of the shoe and wheels attached thereto.
Figure 2:
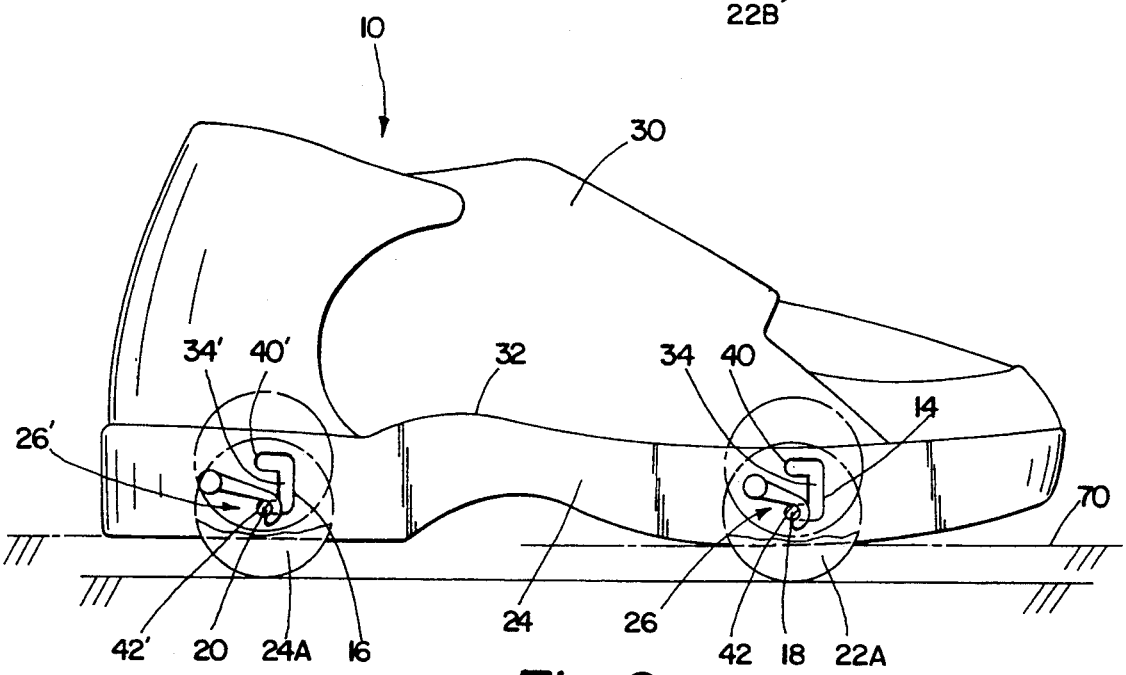
FIG. 2 is a side view of FIG. 1, and illustrates different adjusted positions of the wheels, with phantom lines, with respect to the sole.

Referring now more particularly to the drawings, in all of which like parts are designated by like reference characters, a shoe 10 is illustrated in FIGS. 1 and 2, which is adapted for walking or roller skating. The sole 12 of said shoe 10 is provided with first and second spaced, transversely elongated bores 14 and 16 extending therethrough and disposed in the forward and rearward portions thereof. First and second axles 18 and 20 with wheels 22A, 22B, and 24A, 24B, respectively, are as shown in FIGS. 1–5 inclusive, secured on either end thereof and mounted within the first and second elongated bores 14 and 16, respectively. A mechanism 26 is provided for locking the first and second axles 18 and 20 in a retracted position within said first and second bores 14 and 16 whereby wheels 22A, 22B and 24A, 24B maybe secured above the lower surface 28 of the sole 12 so that the shoe 10 is adapted for normal walking. Alternatively, the mechanism 26 can be adjusted to first and second axles 18 and 20 in extended position below the sole whereby the wheels 22A, 22B, and 24A, 24B extend below lower surface 28 of sole 12 to adapte the shoe 10 for skating.

Referring now to FIGS. 1 and 2, the shoe 10 is preferably an athletic shoe, such as a "Reebock" TM athletic shoe having an upper portion 30 secured to the upper surface 32 of sole 12. Preferably the sole 24 is constructed of a pliable rubber or elastomer material.

A principle feature of this invention is the construction of the sole 12 of the shoe 10 provide first and second spaced, elongated bores ]4 and 16 extending transversely therethrough and disposed in the forward and rearward portions thereof. The width of the said bores 14 and 16 are preferably just slightly larger than the diameter of the axles 18 and 20 to allow the axles to have a sliding fit therein which allows them to be manually moved along the length of the bores 14 and 16 between retracted and extended positions, as discussed in more detail below. Since the shape of the bores 14 and 16 is essentially identical, only bore 14 is described in detail herein. The bore 16 however, is numbered with primed reference numerals which, throughout the specification, represent structural elements which are substantially identical to structural elements represented by the same unprimed reference numerals. The bores 14 and 16 are preferably shaped with a vertically disposed center section 34 and two end sections 36 and 38 disposed at substantially right angles to the center section 34. The end sections 36 and 38 preferably have curved end surfaces 40, 42 with a radius just slightly larger than that of the axle 18 so that axle 18 firmly abuts thereagainst. The end sections 36 and 38 project rearwardly towards the rearward portion of the sole 24 and the bores 14 and 16 therefor have a substantially rearward facing, channel-like shape. The end sections 36 and 38 may also be formed to project in the opposite direction so as to form a substantially forward facing, channel-like shape. While a channel-like shape is preferred, for reasons set forth below, it is also within the terms of the invention to substitute other shapes such as for example a curved shaped with either end located at the same relative location as 40 and 42.

Figure 3:
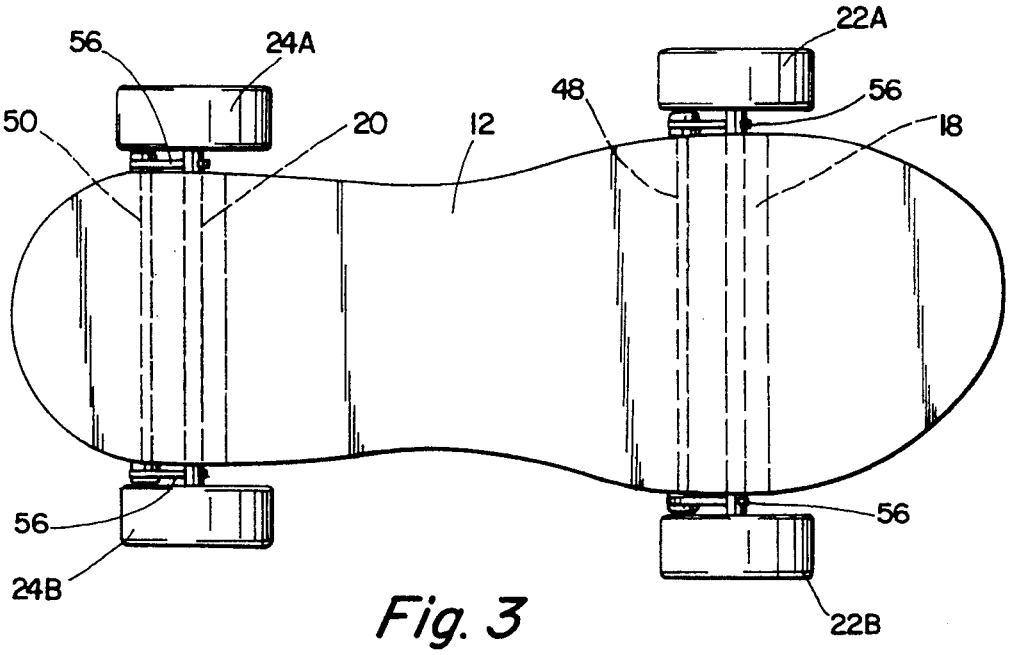
FIG. 3 is a bottom view of the sole of the shoe of FIGS. 1 and 2, showing with hidden lines the relationship between the wheel axles and means for securing the wheels to the sole of the shoe.
Figure 4:
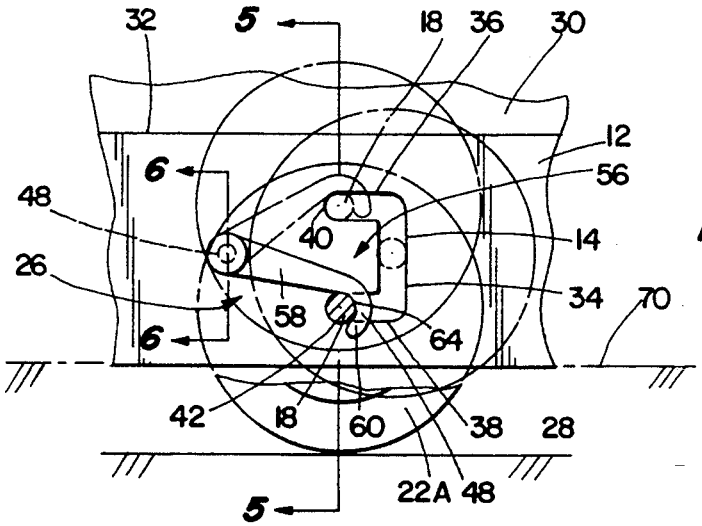
FIG. 4 is a view of an embodiment of my invention illustrating with phantom lines the positioning of locking means for securing the wheel axles so that the wheels are in operative and non-operative positions.
Figure 5:
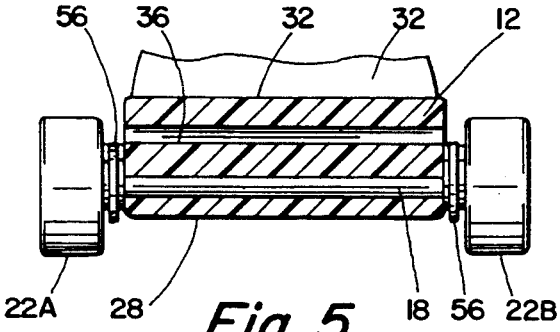
FIG. 5 is a view, partly in cross-section, taken along line 5—5 of FIG. 4, illustrating a wheel axle locked into skating position.

Another principle aspect of this invention is the mechanism 26 which locks the first and second axles 18 and 20, as shown in FIGS. 3 and 4, in either retracted or extended positions within said first and second bores 14 and 16 to connect the shoe 10 from a walking shoe into a roller skating shoe and the reverse. The locking mechanism 26 includes pins 48 and 50 which extend through first and second spaced, elongated bores 52 and 54 and are located in the forward and rearward portions of sole 12 in spaced, aligned relation to bores 14 and 16. Specifically the bores 52 and 54 are preferably positioned to be equidistant from end surfaces 40, 42, and 40', 42+ of bores 14 and 16. This positioning ensures that the wheel axles 20 and 22 are securely locked in place in either the retracted or extended positions.

Figure 6:
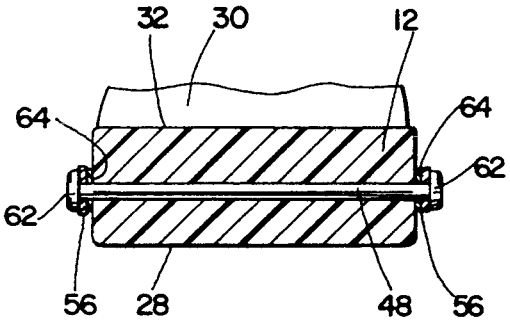
FIG. 6 is a view, partly in cross-section, taken along line 6—6 of FIG. 4, illustrating a pin pivotally securing manually operated hooks to the sole of the shoe.

The locking mechanism 26 includes a hook shaped member 56 formed of an arm 58 with a curved finger 60 at one end and a mounting hole at an opposite end, which mounting hole is adapted to receive pins 48 and 50 at the other end. The pins 48 and 50 as best illustrated in FIG. 3, project outwardly from the sides of the sole 12 of the shoe; and as seen in FIG. 6, have end caps 62 disposed at either end to secure hool shaped members 56 between the end cap 62 and the side walls of sole 12. A washer 62 as shown in FIG. 6, may be mounted on the pins 48 and 50 between the sidewall of the sole 12 and the end cap 62 to ensure that the hook shaped members 56 can easily pivot. The curved finger 60 of the hook has an inner surface 64 shaped with a radius substantially identical to that of the axles 18 and 20 so that the finger 60 can securely lock axles 18 and 20, as described below.

In operation, the shoe 10 can be adapted for walking locking first and second axles 18 and 20 in a retracted position within said first and second bores 14 and 16 whereby, wheels 22A, 22B, and 24A, 24B mounted on said axles are secured above the lower surface 28 of sole 12 so that the shoe 10 is adapted for walking on a surface 70. When the shoe 10 is in the retracted position, wheels 22A, 22B, and 24A, 24B project outward from opposite sides of sole 12. It is to be noted that since the wheels are not confined to the width of the sole, as was common in the prior art, they provide a wider wheel base and hence increased stability in the extended skating position.

To convert the shoe 10 from a walking shoe to a skating shoe, the hook shaped members 56, on either side of shoe 10 are pivoted counterclockwise from their retracted position, as illustrated by dotted lines in FIG. 4, until axle 18 is free to move in end section 36 towards the front of shoe 10 and into the center section 34 of the bore 14. The user can then press wheels 22A and 22B downward towards the bottom surface 28 of sole 12. When the axle 18 is aligned within end section 38, the wheels are pushed towards the rear portion of shoe 10 until axle 18 rests against the rear surface 42 of the bore 14 Then, the hook shaped members 56, on either side of the shoe 10 are pivoted clockwise to their extended position and snap over the axle 18 to securely lock it into place. The pliant material of which the sole 12 is preferably constructed tends to bias the axle 18 into the locked position and to prevent the hook shaped member from accidentally dislodging. Another advantage of the present invention is provided in that the end sections of bore 14 form a tight enclosure with the inner surface 64 of the curved finger 64 and thus prevent vertical movement of the axles 18 and 20 in either skating or walking positions. The shoe 10 is adapted for skating when the first and second axles 18 and 20 are in their extended position within said first and second bores 14 and 16 and the wheels 22A, 22B, and 24A, 24B are disposed below the lower surface 28 of sole 12 whereby the shoe 10 is adapted for skating on a surface 72.

The patents listed herein are intended to be incorporated by reference in their entireties.

It is apparent that there has been provided in accordance with this invention a shoe with skate wheels which is constructed to be alternatively used as a walking shoe or a skating shoe that satisfy the objects, means and advantages set forth hereinbefore. According to the invention, the shoe is constructed so that the skate wheels are quickly, easily, and securely locked into either a retracted walking position or an extended skating position. Further, the shoe has a flexible construction to provide a comfortably walking shoe.

While the invention has been described in connection with embodiments thereof, it is evident that many alternatives, modifications, and variations will be apparent to those skilled in the art in light of the foregoing teachings. Accordingly, the invention is intended to embrace all such alternatives, modifications and variations as fall within the spirit and scope of the appended claims.

What I claim is:

1. A shoe adapted for walking or skating, comprising:

a sole having first and second spaced, elongated bores extending therethrough and disposed in the forward and rearward portions thereof;

first and second axles each having wheels mounted on either end thereof, said first and second axles being disposed in said first and second bores, respectively;

means for locking said first and second axles in a retracted position within said first and second bores whereby said wheels are secured above the lower surface of said sole so that said shoe is adapted for walking and alternatively in an extended position whereby said wheels extend below the lower surface of said sole so that said shoe is adapted for skating.

2. The shoe of claim 1 wherein said bores have a substantially vertical center section with spaced first and second end sections at either end projecting backwards towards the rearward portion of said sole.

3. The shoe of claim 1 wherein the width of said bores is slightly more than the diameter of said first and second axles to allow said axles to having a sliding fit within said first and second bores.

4. The shoe of claim 2 wherein said means for locking said first and second axles comprises a plurality of hook means pivotally secured to said sole for locking said axles in said first and second end sections.

5. The shoe of claim 4 wherein said means for locking further includes:

third and fourth elongated bores in spaced, aligned relation to said first and second bores; and first and second pin elements extending through said third and fourth elongated bores, respectively; and said plurality of said hook means pivotally secured to said first and second pin elements to enable said hook means to move into and out of locking engagement with said first and second axles in either said retracted or said extended position within said first and second bores.

6. The shoe of claim 5 wherein said hook means further includes a plurality of hook shaped members disposed on either side of said sole each having a curved finger with an inner surface shaped with a radius which is substantially identical to that of said first and second axles so that finger can securely lock said first and second axles in said retracted and extended positions.

7. The shoe of claim 6 wherein said third and fourth elongated bores are located equidistant from said first and second axles in either their retracted or second position within said first and second bores.

8. The shoe of claim 1 wherein said wheels mounted on said first and second axles extend outward from the sides of said sole when said wheels are secured in either their retracted or extended positions.

9. A shoe adapted for walking or skating, comprising:

a sole having first and second spaced, elongated bores extending therethrough and disposed in the forward and rearward potions thereof, said bores having a substantially vertical center section with spaced first and second end sections at either end projecting backwards towards the rearward portion of said sole;

first and second axles each having wheels mounted on either end thereof, said first and second axles being disposed in said first and second bores, respectively;

hook means pivotally secured to said sole for locking said axles within said first end sections in a retracted position within said first and second bores whereby said wheels are secured above the lower surface of said sole so that said shoe is adapted for walking and alternatively for locking said axles within said second end sections in an extended position within said first and second bores whereby said wheels extend below the lower surface of said sole so that said shoe is adapted for skating.

10. The shoe of claim 9 further including third and fourth elongated bores in spaced, aligned relation to said first and second bores; and first and second pin elements extending through said third and fourth elongated bores, respectively; and said plurality of said hook means pivotally secured to said first and second pin elements to enable said hook means to move into and out of locking engagement with said first and second axles in either said retracted position or said extended position within said first and second bores.

11. The shoe of claim 10 wherein said hook means further includes a plurality of hook shaped members disposed on either side of said sole each having a curved finger with an inner surface shaped with a radius which is substantially identical to that of said first and second axles so that finger can securely lock said first and second axles in said retracted and extended positions.

* * * * *